US006409100B1

(12) United States Patent
Lundberg

(10) Patent No.: US 6,409,100 B1
(45) Date of Patent: Jun. 25, 2002

(54) ARTICULATED AIR ADMISSION DEVICE

(75) Inventor: Stig Lundberg, Halmstad (SE)

(73) Assignee: Lundberg & Son V.V.S.-Produkter AB, Einskede (SE)

( * ) Notice: Subject to any disclaimer, the term of this patent is extended or adjusted under 35 U.S.C. 154(b) by 0 days.

(21) Appl. No.: 09/680,532

(22) Filed: Oct. 6, 2000

(30) Foreign Application Priority Data

Oct. 7, 1999 (SE) ..... 9903623

(51) Int. Cl.[7] ..... B05B 7/00; B05B 15/08
(52) U.S. Cl. ..... 239/428.5; 239/462; 239/587.4
(58) Field of Search ..... 239/587.4, 587.1, 239/428.5, 462, 461; 138/44, 41

(56) References Cited

U.S. PATENT DOCUMENTS

| | | | | |
|---|---|---|---|---|
| 2,990,122 A | | 6/1961 | Blumberg et al. | |
| 3,047,239 A | * | 7/1962 | Canavan | 239/460 |
| 3,067,953 A | * | 12/1962 | Aghnides | 239/428.5 |
| 3,358,934 A | | 12/1967 | Moen | |
| 3,547,353 A | * | 12/1970 | Pecka | 239/460 |
| 3,623,670 A | | 11/1971 | Wakeman | |
| 4,082,225 A | * | 4/1978 | Haynes | 239/428.5 |
| 4,202,501 A | * | 5/1980 | Haynes | 138/45 |
| 4,221,335 A | * | 9/1980 | Shames et al. | 138/45 |
| 4,244,526 A | | 1/1981 | Arth | |
| 4,657,185 A | | 4/1987 | Rundzaitis | |

FOREIGN PATENT DOCUMENTS

| | | |
|---|---|---|
| DE | 2056552 | 10/1971 |
| DE | 27 45 651 | 4/1978 |
| DE | WO 97/37087 | 10/1997 |

* cited by examiner

*Primary Examiner*—Lesley D. Morris
(74) *Attorney, Agent, or Firm*—Banner & Witcoff, Ltd.

(57) ABSTRACT

An articulated air admission device comprising a lower portion (4) with a mixing mechanism provided with a screen (36), a central portion (3) and an upper portion (2) arranged to be attached to the outlet spout of a water tap, the upper portion (2) being provided with a joint ball (5) facing towards and connected to the central portion (3) which is connected to the lower portion (4) by a thread (18).

6 Claims, 1 Drawing Sheet

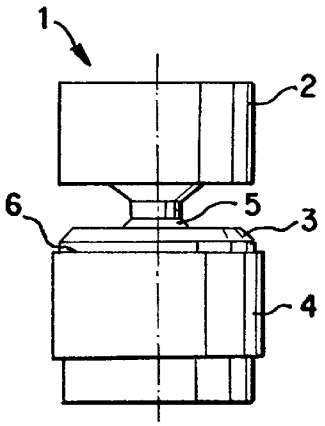
Fig. 1
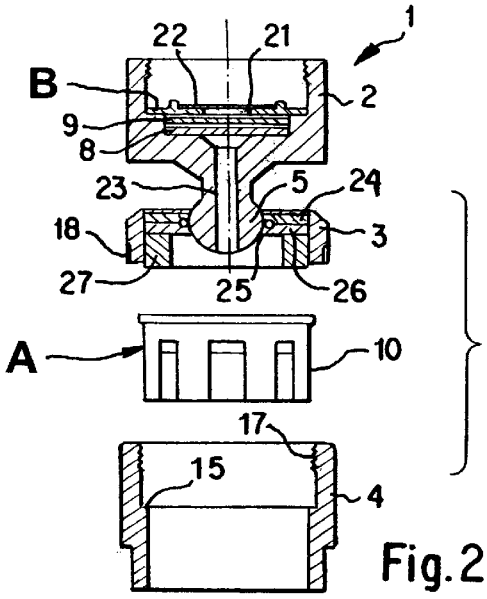
Fig. 2
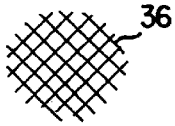
Fig. 3a
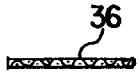
Fig. 3a1
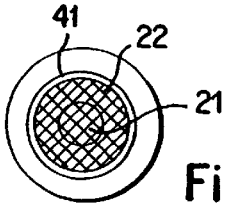
Fig. 4
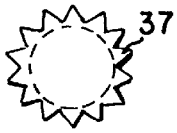
Fig. 3b
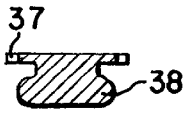
Fig. 3b1
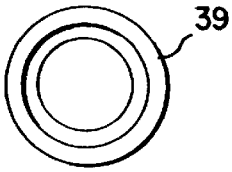
Fig. 3c
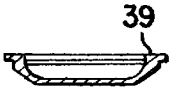
Fig. 3c1
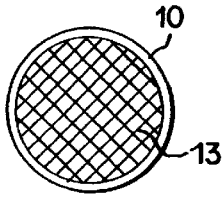
Fig. 3d
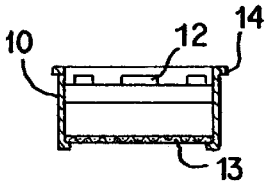
Fig. 3d1

ARTICULATED AIR ADMISSION DEVICE

FIELD OF THE INVENTION

The present invention relates to an articulated device in a jet concentrator attached to the outlet spout of a water tap, which is provided with water and air permeable channels.

BACKGROUND OF THE INVENTION

Jet concentrators of the above kind are previously known. The known jet concentrators are formed with a lower portion comprising an air admission means, a central portion connected to the lower portion by means of a thread and comprising an upwardly facing joint ball and an upper portion to which the joint ball is secured by pressing such that the upper portion is movable round the joint ball. The upper portion is connectable to the outlet spout of a water tap by means of a thread.

When said device is connected to an open water tap, water is pressed through the upper portion against the upper end of the joint ball and then through the joint ball via a water channel in the central portion and further through the air admission means of the lower portion and out into the open air. The upper end of the joint ball is thereby exposed so that it is subjected to the pressure of the entire water system. The material of the joint ball is chromium-plated brass, meaning that in aggressive environments wear damages may arise which could lead to corrosion of the upper end of the joint ball which again results in functional disorders. Further, said wear damages could cause problems as regards tightness and could even cause separation in the ball joint between the upper portion and the central portion.

OBJECT OF THE INVENTION

The object of the present invention is to provide a means in an articulated air admission device by which the above-mentioned disadvantages are eliminated and to substantially reduce the water pressure on the joint ball in an articulated air admission device.

SUMMARY OF THE INVENTION

This object is achieved in that the invention is provided with the characteristics stated in the claims. A joint ball connected to the upper portion faces downwardly towards a jet concentrating air admission means whereby the water pressure on the joint ball is considerably reduced as compared to what it would be if the joint ball were subjected to the line pressure.

BRIEF DESCRIPTION OF THE DRAWINGS

The invention will now be described in more detail using reference numerals, with reference to the accompanying drawings.

FIG. 1 illustrates an articulated air admission device according to the invention.

FIG. 2 is an exploded view partly in section of the air admission device of FIG. 1.

FIGS. 3*a*–3*d* are plan views of parts exploded from portion A of FIG. 2.

FIGS. 3*a*1–3*d*1 are, respectively, sectional views of the exploded parts shown in FIGS. 3*a*–3*d*.

FIG. 4 is a plan view of portion B of FIG. 2.

DESCRIPTION OF THE INVENTION

FIG. 1 illustrates an articulated air admission device 1 according to the invention comprising three externally visible portions, namely an upper portion 2, a central portion 3, and a lower portion 4. The upper portion is arranged to be attached to the outlet spout of a water tap and is provided with a joint ball 5 facing away from the outlet spout. The joint ball is also connected to the central portion which in turn is connected to the lower portion via a threaded connection 6.

FIG. 2 shows that the upper portion is provided with a diaphragm B provided with a restriction 21 and a filter 22 fixedly mounted in the diaphragm. The diaphragm serves as a flow limiting gasket. The diaphragm will be further described with reference to FIG. 4. Immediately below the diaphragm B there is a Teflon® coated screen 9 under which there is a toothed disk 8. The toothed disk 8, the screen 9, and the diaphragm B interact in reducing the water pressure before it reaches the joint ball 5. Further, there is a flow channel 23 extending downwardly through the joint ball 5 in the upper portion. The central portion 3 is pulled onto the joint ball 5 and is locked to the ball by means of a nylon ring 24 which is pressed onto the joint ball. Between the nylon ring 24 and the joint ball there is disposed a sealing O-ring 25 which is held in position by a clamping ring 26. In addition, the clamping ring 26 is held in position by a rubber bushing 27 tensioning the joint axially in that the central portion is screwed onto the lower portion 4. As is also evident from FIG. 2, the lower portion is provided with a mixing means A having a surrounding air inlet sleeve 10 which is suspended on an edge 15 in the lower portion, the mixing means A being further described with reference to FIG. 3. By means of an internal thread 17, the lower portion is connected to a corresponding external thread 18 on the central portion.

FIG. 3 shows an exploded view of the mixing means A. In the direction of flow of the water there is a screen 36. Further in the direction of flow there is a water divider 37 arranged to distribute the water flow along the circumference of the water divider by the water divider being provided with a serrated circumference. The water divider is provided with a bead shaped restriction 38 which together with a water nozzle 39 provides for peripheral distribution of the flow. Further, the screen 36 is embedded in the water nozzle 39. The screen 36, the water divider 37 with restriction 38, the water nozzle 39 and the surrounding air inlet sleeve 10 together make up the mixing means A of the air admission device. The parts of the mixing means A shown in FIG. 3 are formed in such a way as to be snapped together into one unit.

The air inlet sleeve 10 is provided with rectangular holes 12 arranged in the upper portion of the sleeve for admitting air into the sleeve with the water by means of the ejector effect. In addition, the air inlet sleeve is provided with a jet divider 13 in the form of one or more stainless steel nets. The air inlet sleeve 10 is also provided with an edge 14 arranged to interact with the corresponding edge 15 in the lower portion 4 so that the mixing means A fits into the sleeve to an axial position which does not enable it to project beyond the lower portion 4.

FIG. 4 shows a circular diaphragm B arranged with the restriction 21 in the form of a circular opening dimensioned for the respective flow. For example, a diaphragm with a larger opening diameter is used for outlet spouts in kitchens which diaphragms permit a water flow of 9–10 l/min as opposed to outlet spouts in wash basins, which diaphragms permit a water flow of 6–7 l/min. The filter 22 is fixedly mounted in the diaphragm, covering the restriction, and it is either pressed into a diaphragm edge 41 or embedded in the diaphragm. The filter 22 of the diaphragm is made of a metallic net covered with an anti-adhesive coating. The diaphragm B is made of a resilient material permitting a relatively large, non-permanent, deformation, wherein usually rubber but also polymeric materials may be used.

The function of the jet concentrator is to suck in air, by means of the ejector effect, upwardly into the space between the lower portion 4 and the air inlet sleeve 10 owing to the water flowing through the water admission means, The air is then let in by suction through the rectangular holes 12 and is admitted into the water flow.

What is claimed is:

1. An articulated air admission device comprising a lower portion with a mixing means provided with a screen mounted in the device as a separate unit, a central portion, and an upper portion arranged to be attached to the outlet spout of a water tap, characterized in that the upper portion is provided with a joint ball facing towards and connected to the central portion which is connected to the lower portion by means of a thread and that a pressure limiting means comprising a flow limiting diaphragm, a toothed disk, and a screen, is disposed in the upper portion to reduce the water pressure before it reaches the joint ball.

2. An air admission device according to claim 1, characterized in that the diaphragm is provided with a filter.

3. An air admission device according to claims 2, characterized in that the peripheral parts of the diaphragm are arranged as a gasket intended to seal between the upper portion and the outlet spout.

4. An air admission device according to claim 3, characterized in that the joint ball is connected at the central portion by being inserted through the central portion and then pressed in through a nylon ring which is mounted to prevent the joint ball from separating from the central portion.

5. An air admission device according to claim 4, characterized in that an O-ring is mounted in the nylon ring to seal between the joint ball and the nylon ring.

6. An air admission device according to claim 5, characterized in that the filter of the diaphragm consists of a metallic net covered with an anti-adhesive coating.

* * * * *